US011686051B2

(12) United States Patent
Hester

(10) Patent No.: US 11,686,051 B2
(45) Date of Patent: Jun. 27, 2023

(54) PONDING ALLEVIATION PROCESS

(71) Applicant: PIM CS LLC, Arlington, VA (US)

(72) Inventor: Aaron Hester, Waxhaw, NC (US)

(73) Assignee: PIM CS LLC, Arlington, VA (US)

( * ) Notice: Subject to any disclaimer, the term of this patent is extended or adjusted under 35 U.S.C. 154(b) by 0 days.

(21) Appl. No.: 17/958,034

(22) Filed: Sep. 30, 2022

(65) Prior Publication Data

US 2023/0146557 A1 May 11, 2023

Related U.S. Application Data

(60) Provisional application No. 63/277,427, filed on Nov. 9, 2021.

(51) Int. Cl.

| | |
|---|---|
| ***E01C 11/22*** | (2006.01) |
| ***E01C 23/09*** | (2006.01) |
| ***E01C 23/08*** | (2006.01) |

(52) U.S. Cl.

CPC ..... *E01C 11/229* (2013.01); *E01C 23/08* (2013.01); *E01C 23/09* (2013.01)

(58) Field of Classification Search

CPC ..... E01C 11/229; E01C 23/08; E01C 23/09
See application file for complete search history.

(56) References Cited

U.S. PATENT DOCUMENTS

| | | | | |
|---|---|---|---|---|
| 3,873,226 | A | 3/1975 | Teach | |
| 4,186,968 | A | 2/1980 | Barton | |
| 4,357,120 | A | 11/1982 | MacDonald | |
| 4,701,069 | A * | 10/1987 | Whitney | E01C 11/224 404/96 |
| 5,549,412 | A | 8/1996 | Malone | |
| 6,227,620 | B1 * | 5/2001 | Page | E01C 23/088 451/236 |
| 6,682,261 | B1 | 1/2004 | Karamihas et al. | |
| 6,827,074 | B2 | 12/2004 | Gardner | |
| 6,896,604 | B1 | 5/2005 | Taylor et al. | |
| 7,000,606 | B2 | 2/2006 | Gardner | |
| 7,143,760 | B2 | 12/2006 | Gardner | |
| 7,748,789 | B2 | 7/2010 | Freeburn | |
| 7,789,587 | B2 * | 9/2010 | James | E02F 3/967 404/96 |
| 8,733,845 | B2 | 5/2014 | Bollinger | |
| 8,839,778 | B2 | 9/2014 | South | |
| 8,992,119 | B2 * | 3/2015 | Parsons, Jr. | E01C 23/088 404/91 |
| 9,422,678 | B1 * | 8/2016 | Baaske | E01C 23/09 |

(Continued)

FOREIGN PATENT DOCUMENTS

| | | |
|---|---|---|
| EP | 2431523 A2 | 3/2012 |

OTHER PUBLICATIONS

Invitation to Pay Additional Fees, dated Jan. 18, 2023, in corresponding International Patent Application No. PCT/US22/48553.

(Continued)

*Primary Examiner* — Abigail A Risic
(74) *Attorney, Agent, or Firm* — Locke Lord LLP; Daniel J. Fiorello

(57) ABSTRACT

A method can include removing material from surface material to regrade the surface material to include a declining elevation between a first point and a second point to eliminate ponding on the surface material between the first point and the second point.

9 Claims, 9 Drawing Sheets

(56) References Cited

U.S. PATENT DOCUMENTS

| | | | | |
|---|---|---|---|---|
| 2003/0069668 | A1* | 4/2003 | Zurn | E01C 23/07 700/245 |
| 2006/0127180 | A1 | 6/2006 | Hall et al. | |
| 2011/0037307 | A1* | 2/2011 | Bollinger | E01C 23/09 299/41.1 |
| 2012/0301220 | A1* | 11/2012 | Snoeck | E01C 23/07 701/50 |
| 2014/0147207 | A1* | 5/2014 | Parsons, Jr. | E01C 23/065 404/91 |
| 2019/0154442 | A1* | 5/2019 | Annovi | H04N 13/254 |

OTHER PUBLICATIONS

International Search Report, of the United States Patent and Trademark Office, as ISA, dated Mar. 24, 2023, in corresponding International Patent Application PCT/US22/48553.

* cited by examiner

PONDING ALLEVIATION PROCESS

CROSS-REFERENCE TO RELATED APPLICATIONS

This application claims priority to and the benefit of U.S. Provisional Application No. 63/277,427, filed Nov. 9, 2021, the entire contents of which are herein incorporated by reference in their entirety.

FIELD

This disclosure relates to ponding, for example, on roadways.

BACKGROUND

After rainfall, water draining onto streets often does not drain effectively into catch basins, causing pools of water that block pedestrian walkways or streets. These pools of water also degrade infrastructure at an accelerated rate, causing them to need more upgrades. Traditionally, the only way to solve this problem is to completely demolish and replace the infrastructure, replacing it with pavement or gutter pans that have a proper slope, diverting draining water effectively to catch basins.

Such conventional methods and systems have generally been considered satisfactory for their intended purpose. However, there is still a need in the art for improved ponding alleviation processes. The present disclosure provides a solution for this need.

SUMMARY

In accordance with at least one aspect of this disclosure, a method can include removing material from surface material to regrade the surface material to include a declining elevation between a first point and a second point to eliminate ponding on the surface material between the first point and the second point. In certain embodiments, removing material can include cutting the surface material with a horizontal saw. Any other suitable method of removing material is contemplated herein.

The method can include determining an actual elevation of a series of actual elevation points along a line of the surface material between the first point and the second point. Removing material can be done as a function of the actual elevation of the series of actual elevation points.

The method can include plotting the actual elevation points. The method can also include plotting a new elevation line comprised of new elevation points at the same locations as the actual elevation points such that the new elevation line includes a decline in elevation between the first point and the second point.

The method can further include determining a removal depth at each point as a difference between the actual elevation points and the new elevation points plotted. In this regard, removing material can include removing material at each actual elevation point to the respective removal depth.

The method can include removing material between each actual elevation point after removing material at each actual elevation point to define a cut line approximating the new elevation line in the surface material such that the cut line declines allowing flow between the first point and the second point. Removing material can further include smoothing the cut line to be flush with the surface material.

The surface material can be an asphalt roadway, for example. In certain embodiments, the cut line can be defined at an intersection of the roadway and a sidewalk. Any other suitable surface type and/or location for the cut line is contemplated herein.

In accordance with at least one aspect of this disclosure, a roadway can include a cut line defined therein that regrades the surface material to include a declining elevation between a first point and a second point to eliminate ponding on the surface material between the first point and the second point. In certain embodiments, the cut line can be defined at an intersection of the roadway and a sidewalk. The cut line can include any suitable cut line disclosed herein, e.g., as described above.

In accordance with at least one aspect of this disclosure, a roadway can include a road surface, and a plurality of spaced cuts defined in the road surface, the plurality of spaced cuts defining a line to be cut. The plurality of spaced cuts can be formed to respective depths of successively declining elevation.

In certain embodiments, the line to be cut lead to a drain (e.g., directly or indirectly). The plurality of spaced cuts can include a semi-circular horizontal saw shape. The plurality of spaced cuts can be formed obliquely into the road surface.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIGS. 8A, 8B, 8C, and 8D shows an embodiment of a finished cut line being tested with water flow, wherein FIG. 8A shows the water flow along the cut line at zero seconds, FIG. 8B shows the water flow at 5 seconds, FIG. 8C shows the water flow at 10 seconds, and FIG. 8D shows the water flow at 15 seconds wherein the water has reached a drain.

DETAILED DESCRIPTION

Figure 1:
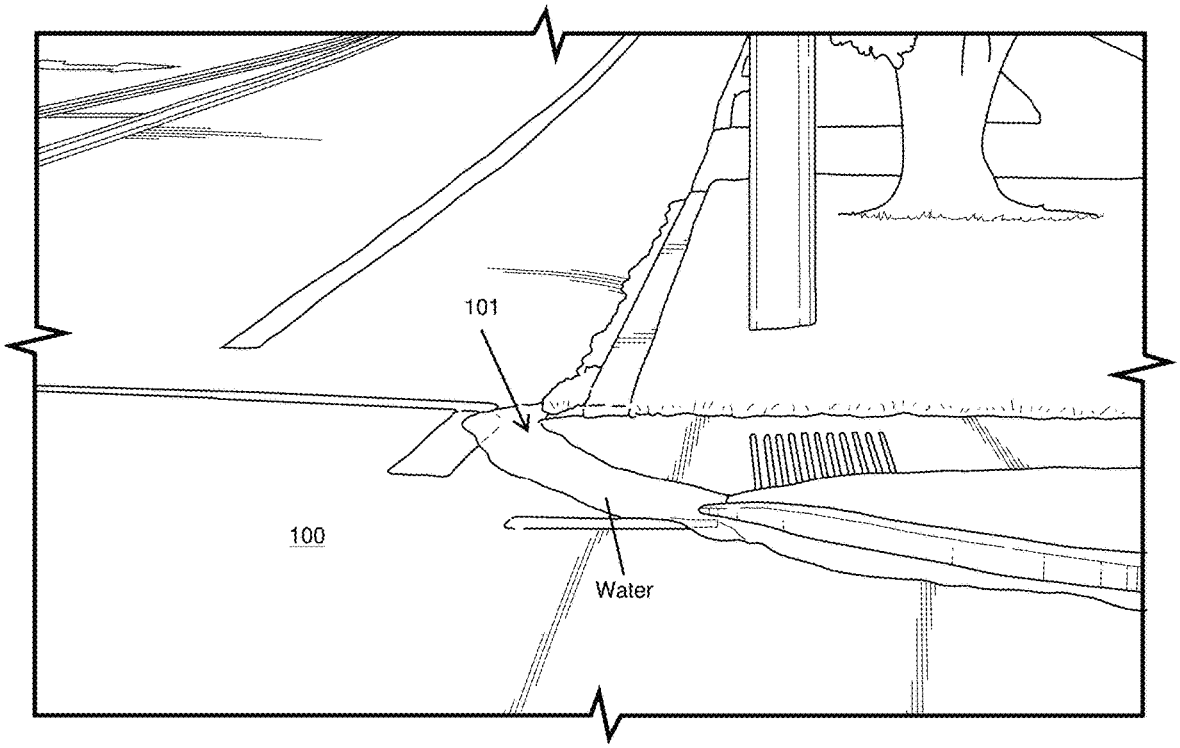
FIG. 1 is a perspective view of an embodiment of a roadway experiencing ponding in accordance with this disclosure.

Reference will now be made to the drawings wherein like reference numerals identify similar structural features or aspects of the subject disclosure. For purposes of explanation and illustration, and not limitation, an illustrative view of an embodiment of a method in accordance with the disclosure is depicted in FIGS. 1-9. Certain embodiments described herein can be used to regrade roadways or other surfaces to alleviate ponding and restore proper drainage, for example.

Figure 2:
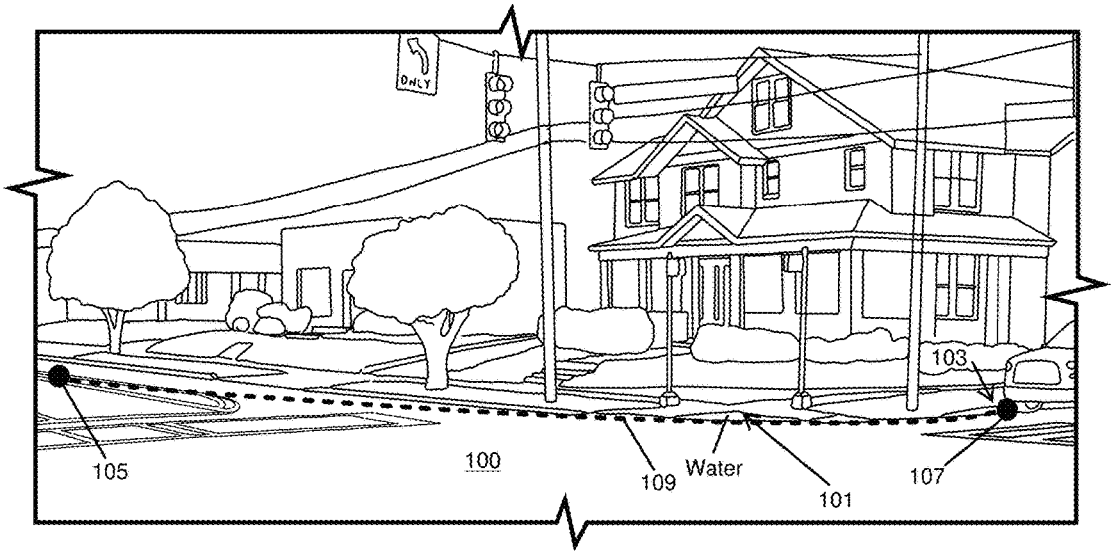
FIG. 2 is a perspective view of an embodiment of the roadway of FIG. 1, showing an embodiment of an elevation line overlaid thereon.
Figure 3A:
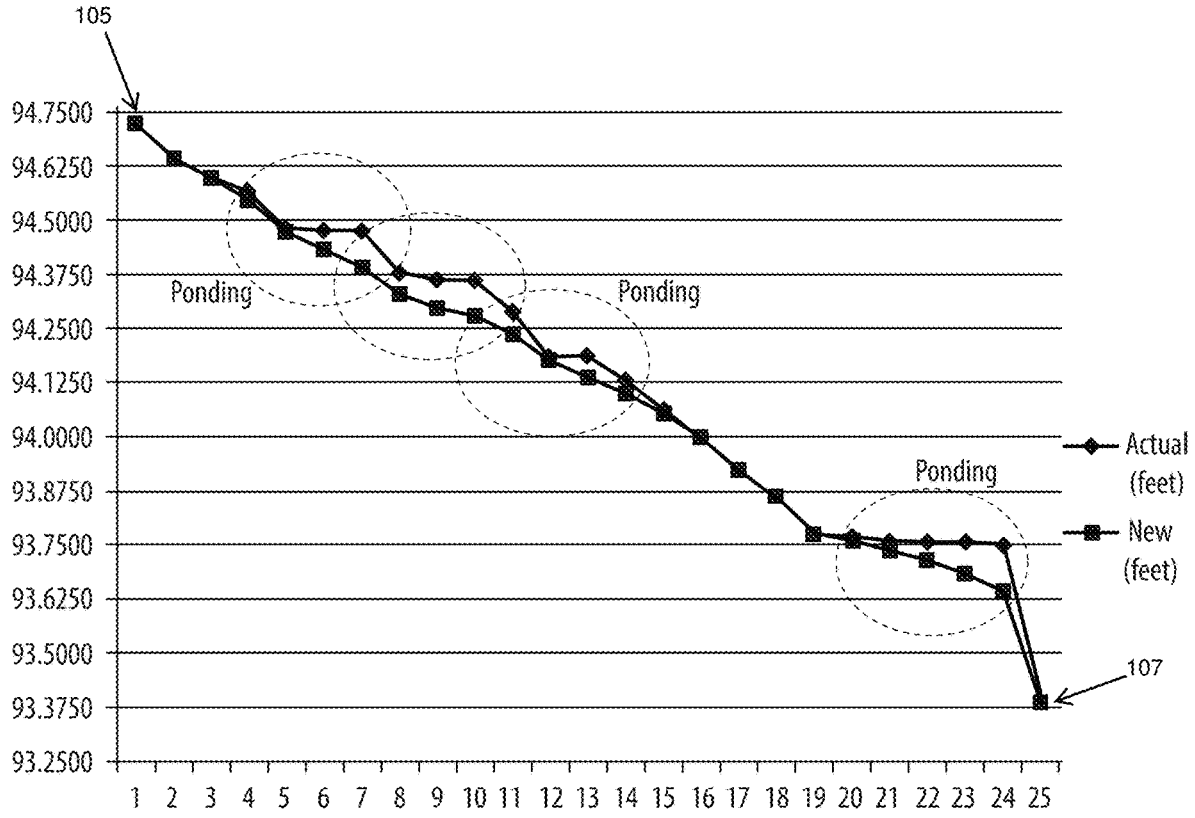
FIG. 3A is a chart showing a series of actual elevation points along the line of FIG. 2, and showing a new elevation line plotted to alleviate ponding (e.g., by removing plateaus through lowering certain actual elevation points)

In accordance with at least one aspect of this disclosure, referring generally to FIGS. 1-9 a method can include removing material from surface material (e.g., pavement, concrete gutter pans, asphalt, any suitable roadway portion or accessible route, and/or any other suitable surface material or combinations thereof) to regrade the surface material to include a declining (e.g., continuously or in any suitable step pattern) elevation between a first point (e.g., an initial point such as a ponding location 101 as shown in FIG. 1) and a second point (e.g., a final point such as a drain 103 as shown in FIGS. 8A-8D) to eliminate ponding on the surface material between the first point 105 and the second point 107 (e.g., as shown in the plot of FIG. 3A). In certain embodiments, removing material can include cutting the surface material with a horizontal saw (e.g., a sidewalk flush-cut saw). Any other suitable method of removing material (e.g., grinding, chipping, chiseling) using any suitable tool (manual or automated) is contemplated herein.

The method can include determining an actual elevation (e.g., using elevation measurements) of a series of actual elevation points (e.g., actual surface points) along a line 109 (e.g., as shown in FIG. 2) of the surface material between the first point 105 and the second point 107 (before removing material). Removing material can then be done as a function of the actual elevation of the series of actual elevation points. Any suitable spacing of points for measurement and material removal is contemplated herein.

The method can also include using LIDAR, sonar, or stereographic cameras to determine a 3-dimensional elevation and relative elevation. The method can also include using mathematical analyses to determine the approximate scope and severity of ponding in a location, including using statistical analyses to determine approximate days a certain ponded area would take to evaporate.

The method can include plotting the actual elevation points (e.g., as shown in FIG. 3A). Any suitable plotting and/or mapping of points is contemplated herein. For example, in certain embodiments, a 3D topography can be created and select points identified to make a new top from in the field. For example, embodiments can utilize a mobile 3D scanner to take the elevation points instead of or in addition to laser elevations The method can also include plotting a new elevation line comprised of new elevation points (e.g, as shown in FIG. 3A), e.g., at the same locations as the actual elevation points such that the new elevation line includes a decline in elevation between the first point and the second point. In certain embodiments, the new elevation line can be a 2D line, a 3D line, and/or can be a 3D surface area, for example. It is contemplated that a new line module can be configured to receive the actual elevation points and to determine the new elevation points automatically, e.g., to eliminate plateaus in the line and constrained by feasible material removal depths (e.g., within 6 inches). The new line module can include any suitable hardware and/or software module(s).

Figure 3B:
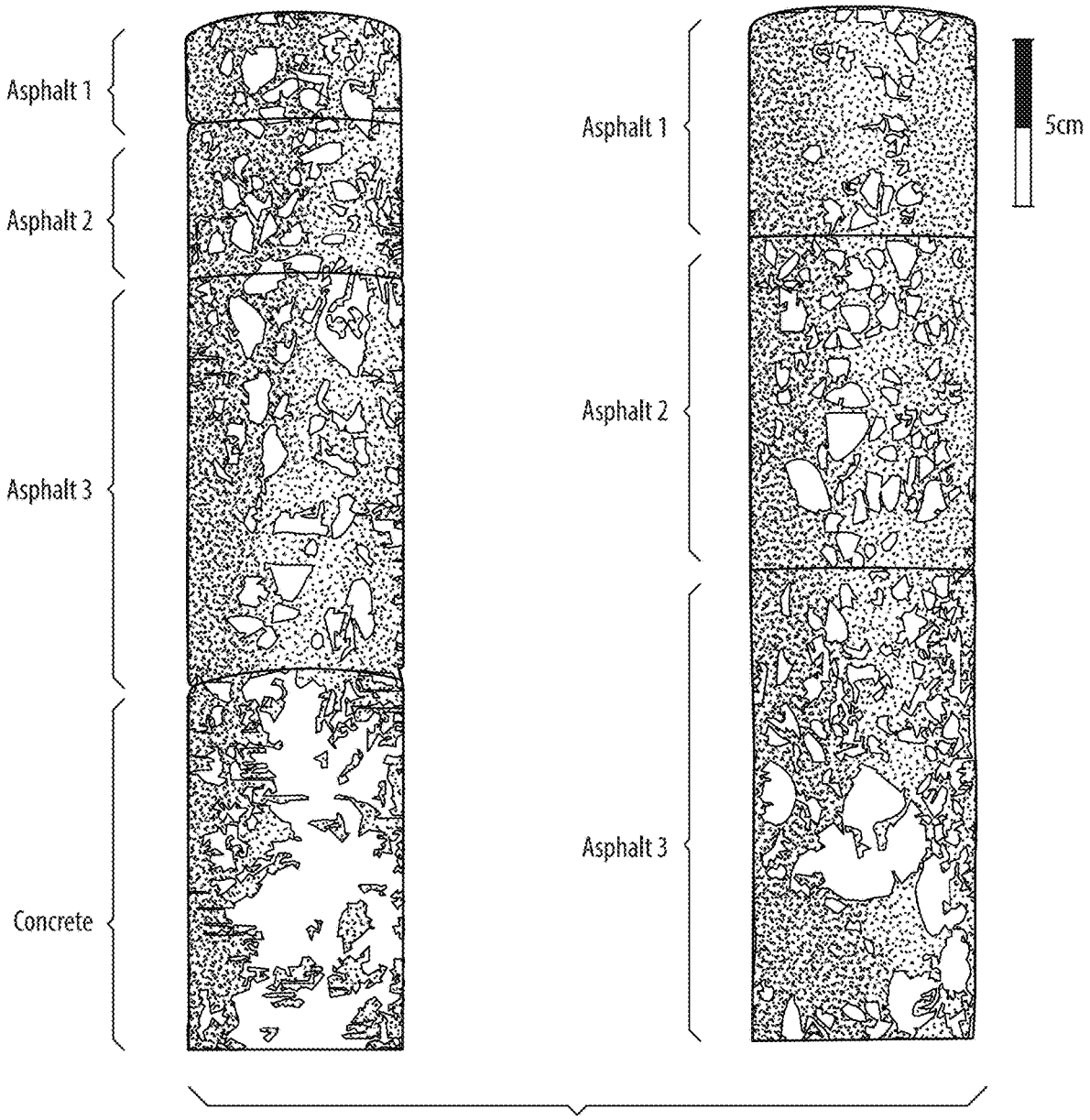
FIG. 3B shows an image of an embodiment of a core sample used to determine feasibility of the new elevation line.

The method can further include determining a removal depth at each point as a difference between the actual elevation points and the new elevation points plotted. The new line module can be configured to output depths at each point to be cut. A feasibility study can include one or more core samples (e.g., as shown in FIG. 3B) or other suitable method for determining whether the surface material is deep enough to allow for sufficient or desired material removal. The new line module can be configured to receive the core sample data and constrain its output to a maximum depth defined by a characteristic of the core sample (e.g., a depth of asphalt in the core sample).

Removing material can include starting with removing material at each actual elevation point to the respective removal depth (e.g., at each actual point 111 to a depth of the new elevation point if any deeper than the actual elevation point 111). An example of point removal is shown in FIGS. 4, 5, 6, and 7.

Figure 6:
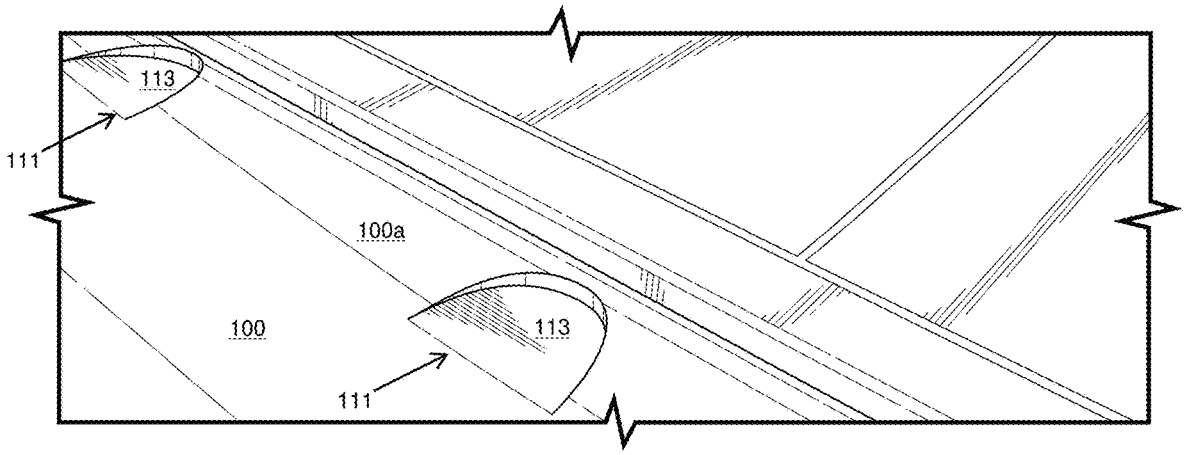
FIG. 6 shows another embodiment of a cut, deeper than the cut of FIG. 5, to reduce another actual elevation point to a lower new elevation point.
Figure 7:
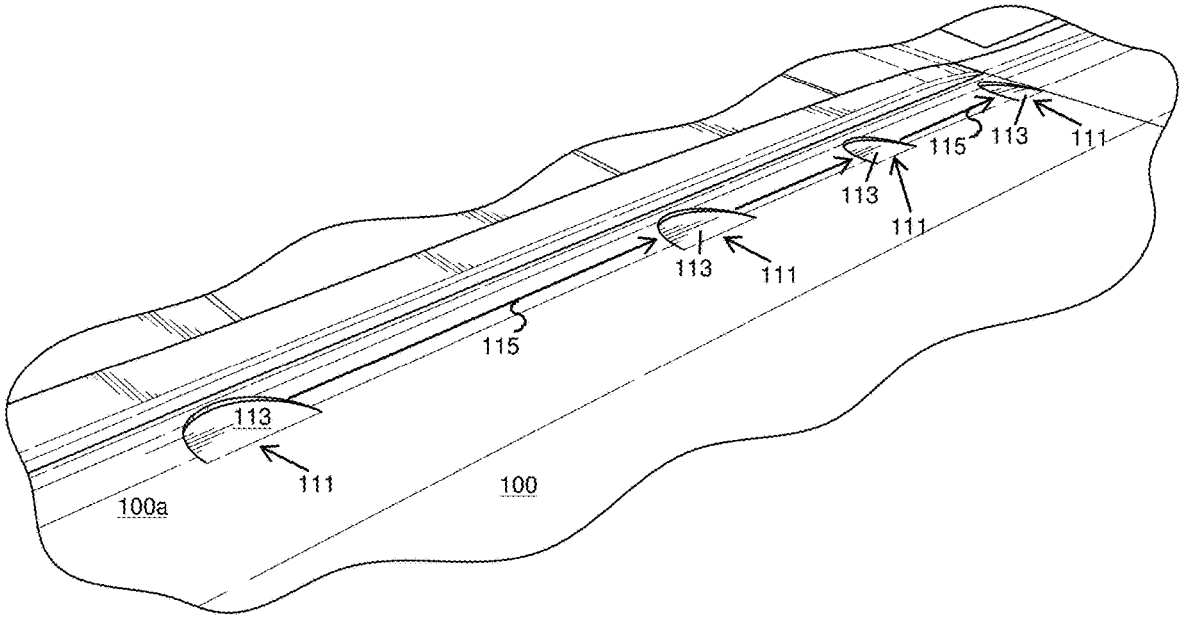
FIG. 7 shows a series of new elevation points cut along the line of the roadway.

The method can include removing material between each actual elevation point 111 after removing material at each actual elevation point to define a cut line approximating the new elevation line in the surface material such that the cut line declines (e.g., continuously) allowing flow between the first point and the second point, e.g., as shown in FIGS. 8A-8D. For example, removing material can include creating a smooth ramp between the adjacent actual elevation points 111 (e.g., such that cuts 113 at the points 111 as shown in FIGS. 6 and 7 are smoothed out and have no lip along the direction of the cut line, e.g., as shown in FIGS. 8A-8D). Removing material can further include smoothing the cut line to be flush with the surface material (e.g., to create a smooth lateral ramp).

The surface material can be or include asphalt roadway, for example. In certain embodiments, the surface material can be or include concrete gutter material (e.g., at the edge of an asphalt roadway) and/or accessible roadway material (e.g., concrete sidewalk material, etc.). The surface material that is cut can be a combination of materials (e.g., asphalt and concrete at the edge of the asphalt). In certain embodiments, the cut line can be defined at an intersection of the roadway and a sidewalk, e.g., as shown in FIG. 1. Any other suitable surface type and/or location for the cut line is contemplated herein.

In accordance with at least one aspect of this disclosure, a roadway 100 can include a cut line (e.g., as shown in FIGS. 8A-8D) defined therein that regrades the surface material to include a declining elevation between a first point and a second point to eliminate ponding on the surface material between the first point and the second point. In certain embodiments, the cut line can be defined at an intersection of the roadway and a sidewalk (e.g., and can be any suitable width into the surface material (e.g., 6 to 12 inches). The cut line can include any suitable cut line disclosed herein, e.g., as described above.

In accordance with at least one aspect of this disclosure, referring to FIGS. 6 and 7, for example, a roadway 100 can include a road surface 100*a* and a plurality of spaced cuts 113 (e.g., at actual points 111) defined in the road surface 100*a*, the plurality of spaced cuts defining a line to be cut 115 (e.g., into the cut line). The plurality of spaced cuts 113 can be formed to respective depths of successively declining elevation (e.g., the absolute elevation of each point declines).

In certain embodiments, the line to be cut 115 leads to a drain (e.g., directly or indirectly e.g., such that the cut line 117). Any other suitable location to direct the water to is contemplated herein (e.g., a catch basin, fall line, a gutter, or any other suitable terminal point). The line to be cut can be made to end at the final location the water flows to, or any other suitable location upstream of the final location (e.g., upstream of the drain). The plurality of spaced cuts 113 can include a semi-circular horizontal saw shape (e.g., with the outer radius facing the sidewalk), for example. The plurality of spaced cuts 113 can be formed obliquely into the road surface (e.g., downwardly angled such that a center of the semicircle is less deep than the outer radius).

In accordance with this disclosure, an example of ponding at accessible routes to pedestrians, bikes, and vehicular traffic is shown in FIG. 1. A diagrammatic example of Topographical Laser Surveyed Elevations and Mapping is shown in FIG. 2. The results of such an analysis can be plotted and evaluated for feasibility. Any suitable type of survey and/or point mapping is contemplated herein.

FIG. 3A shows an embodiment of a Topographical Feasibility Analysis and Adjusted Topographical Adjustment Mapping. It can be seen that ponding can occur where the actual line flattens or raises instead of declines in elevation. The new line, e.g., as shown, can be defined to maintain a consistent decline in elevation. The vertical scale can be in feet, for example. As shown in FIG. 3B, when a required depth for material removal is defined based on the elevation mapping, e.g., as shown in FIG. 3, a core sample can be taken to determine whether removing material to the required depth to provide a the desired new elevation point is feasible (e.g., whether the is sufficient asphalt to cut to the required depth).

Figure 4:
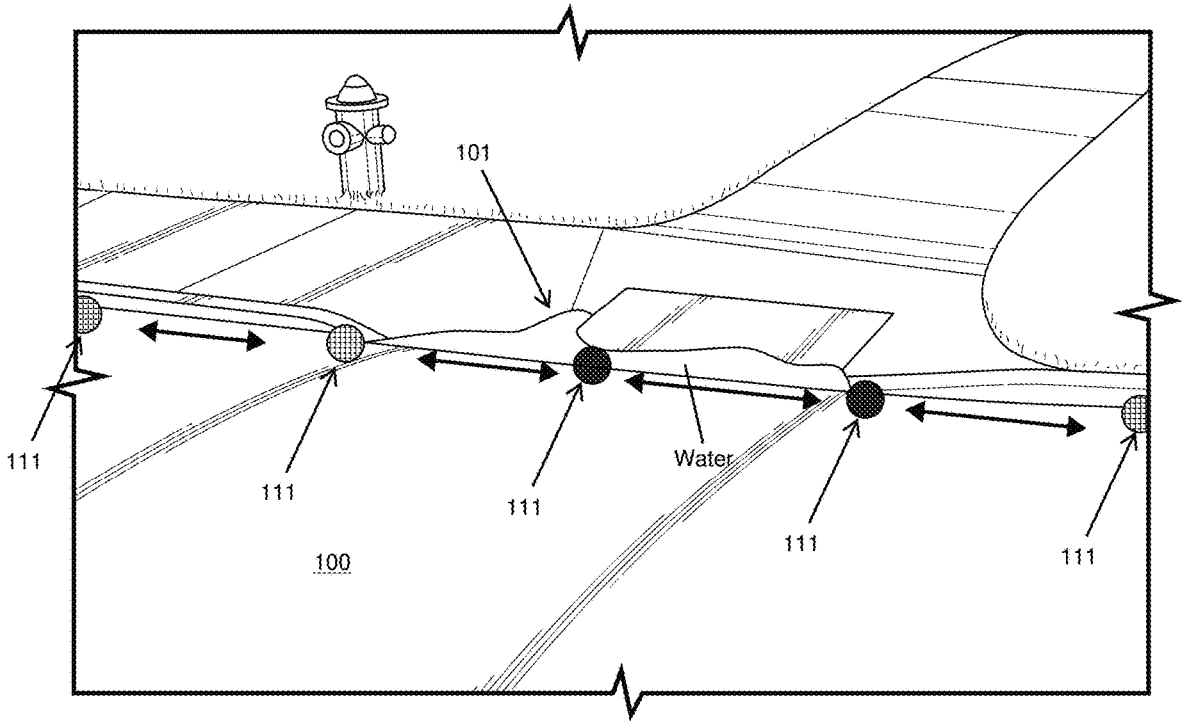
FIG. 4 is a perspective view of an embodiment of a roadway showing example elevation points overlaid thereon.
Figure 5:
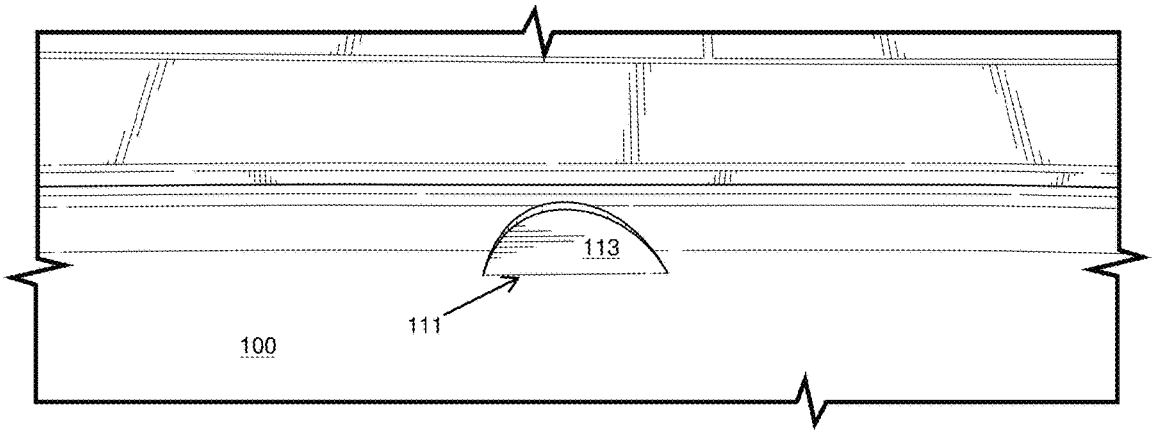
FIG. 5 shows an embodiment of a cut into the surface material to reduce an actual elevation point to the new elevation point.

In FIG. 4, sample proposed elevation adjustment points (shown in yellow) and no adjustment points (are shown in black). FIG. 5 shows an example adjusted elevation point of about 0.50 inches. FIG. 6 shows an example adjusted elevation point of about inch.

Figure 8A:
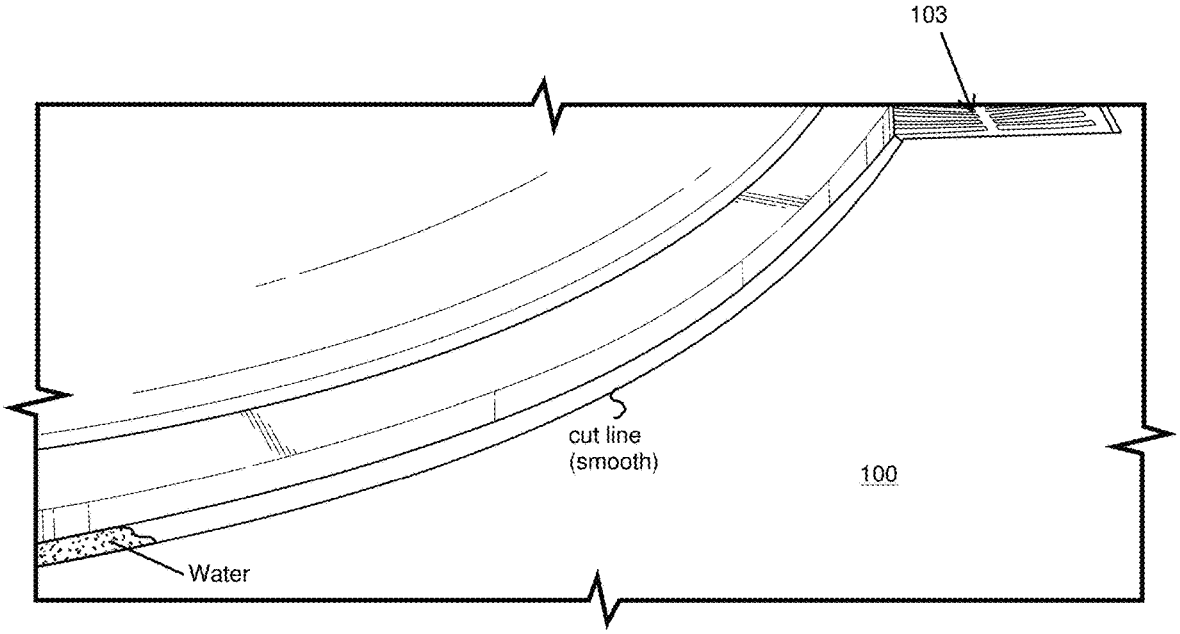
Figure 8B:
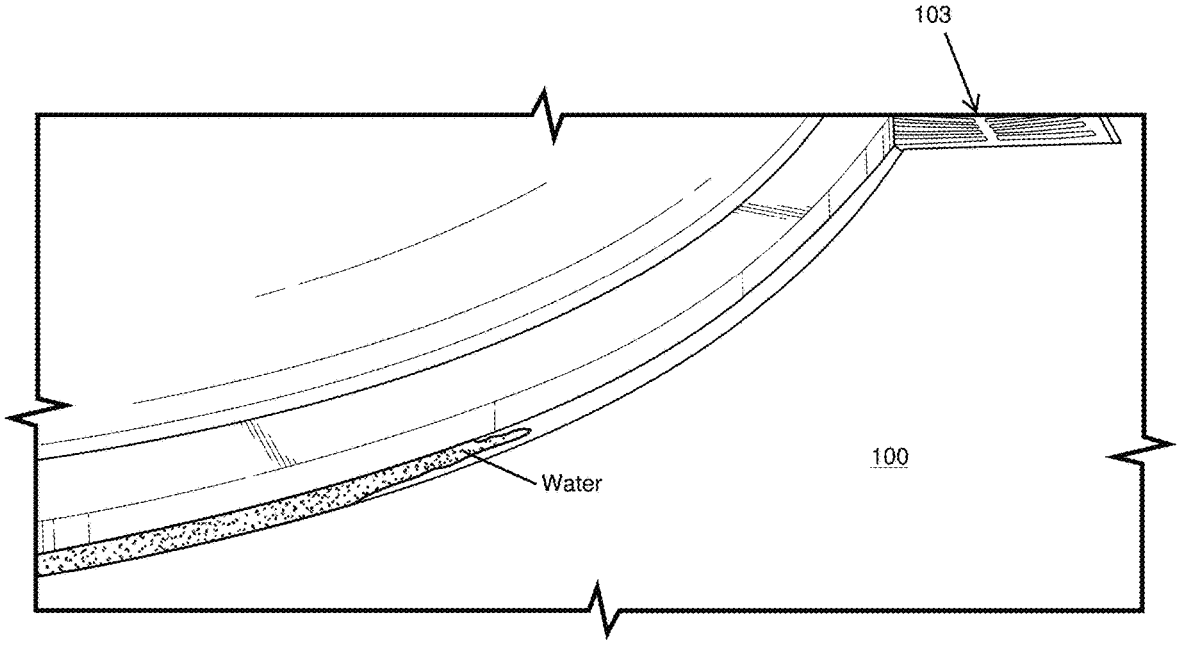
Figure 8C:
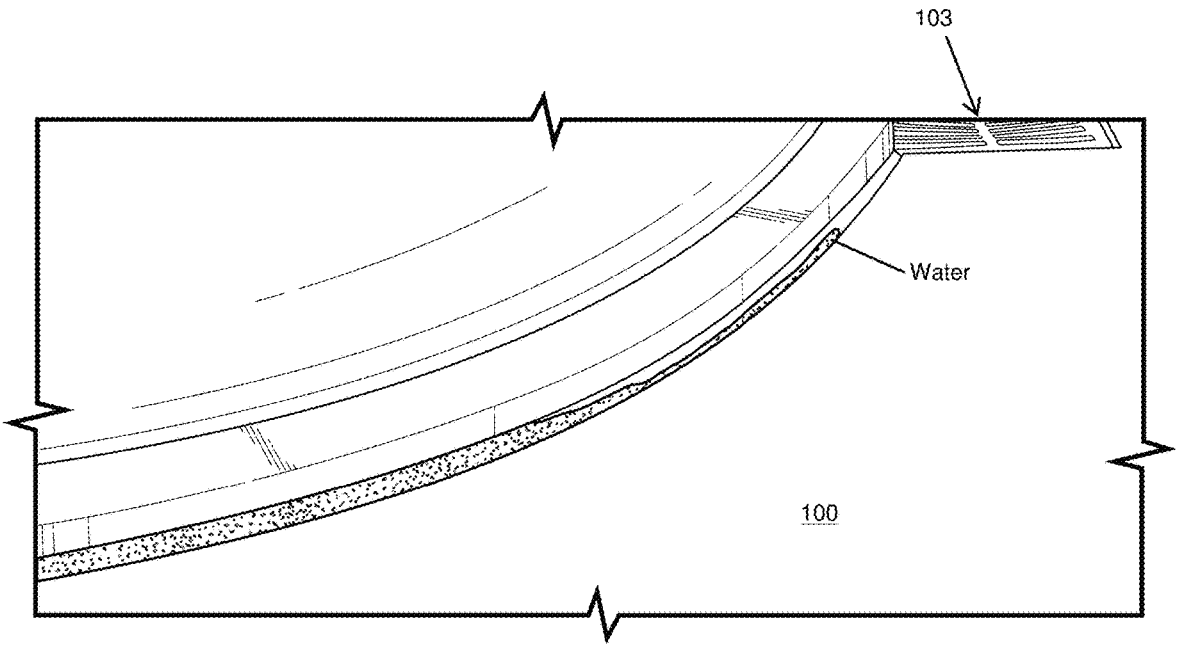
Figure 8D:
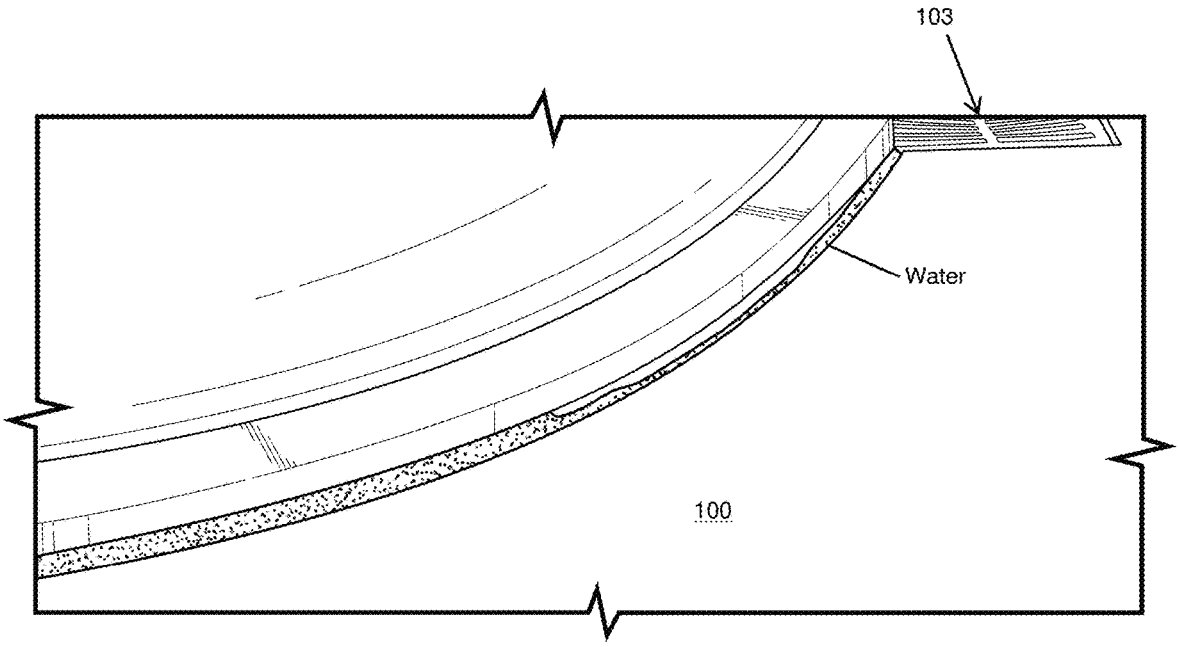
Figure 9:
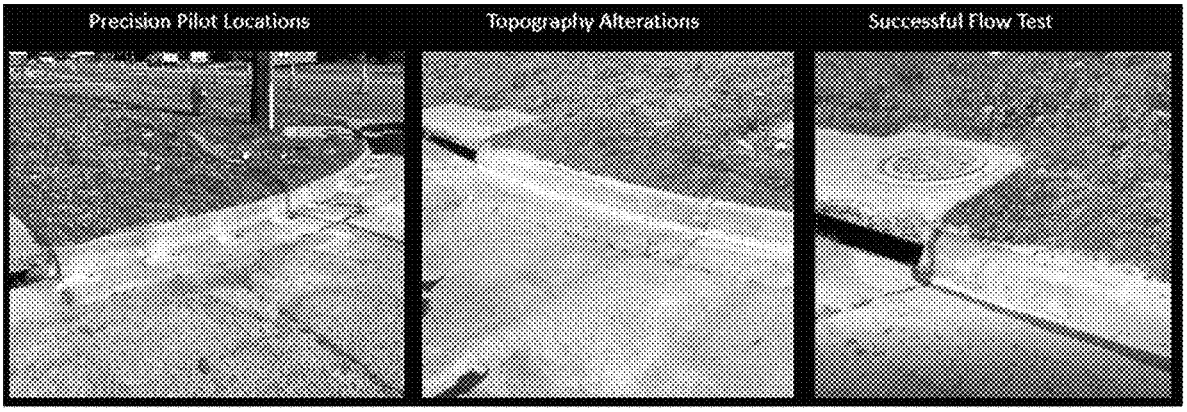
FIG. 9 shows images of an embodiment of a method in accordance with this disclosure.

FIGS. 8A-8D shows water flowing to the catch basin (e.g., drain 103) instead of pooling in the roadway. FIG. 8A shows the flow at zero seconds. FIG. 8B shows the flow at five seconds. FIG. 8C shows the flow at ten seconds. FIG. 8D shows the flow at 15 seconds. As can be seen, the water is able to flow without ponding on to the roadway.

Embodiments can enable technicians to measure and plot the exact correct slopes that would allow water to drain correctly, e.g., on a roadway where the roadway meets the sidewalk. Embodiments allow technicians to create those slopes without replacing or even damaging existing infrastructure. Embodiments can be used to eliminate ponding by removing material on a roadway in a controlled and feasible way without damaging the roadway or other infrastructure.

As will be appreciated by those skilled in the art, aspects of the present disclosure may be embodied as a system, method or computer program product. Accordingly, aspects of this disclosure may take the form of an entirely hardware embodiment, an entirely software embodiment (including firmware, resident software, micro-code, etc.), or an embodiment combining software and hardware aspects, all possibilities of which can be referred to herein as a "circuit," "module," or "system." A "circuit," "module," or "system" can include one or more portions of one or more separate physical hardware and/or software components that can together perform the disclosed function of the "circuit," "module," or "system", or a "circuit," "module," or "system" can be a single self-contained unit (e.g., of hardware and/or software). Furthermore, aspects of this disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of this disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of this disclosure may be described above with reference to flowchart illustrations and/or block diagrams of methods, apparatus (systems) and computer program products according to embodiments of this disclosure. It will be understood that each block of any flowchart illustrations and/or block diagrams, and combinations of blocks in any flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in any flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A method, comprising:

removing material from surface material to regrade the surface material to include a declining elevation between a first point and a second point to eliminate ponding on the surface material between the first point and the second point;

plotting the actual elevation points; and plotting a new elevation line comprised of new elevation points at the same locations as the actual elevation points such that the new elevation line includes a continuously decline in elevation between the first point and the second point.

2. The method of claim 1, wherein removing material includes cutting the surface material with a horizontal saw.

3. The method of claim 1, further comprising determining an actual elevation of a series of actual elevation points along a line of the surface material between the first point and the second point, wherein removing material is done as a function of the actual elevation of the series of actual elevation points.

4. The method of claim 1, further comprising determining a removal depth at each point as a difference between the actual elevation points and the new elevation points plotted.

5. The method of claim 4, wherein removing material includes removing material at each actual elevation point to the respective removal depth.

6. The method of claim 5, further comprising removing material between each actual elevation point after removing material at each actual elevation point to define a cut line approximating the new elevation line in the surface material such that the cut line declines allowing flow between the first point and the second point.

7. The method of claim 6, wherein removing material further comprising smoothing the cut line to be flush with the surface material.

8. The method of claim 1, wherein the surface material is an asphalt roadway.

9. The method of claim 1, wherein the cut line is defined at an intersection of the roadway and a sidewalk.

* * * * *